US005156210A

United States Patent [19]

Roth

[11] Patent Number: 5,156,210

[45] Date of Patent: Oct. 20, 1992

[54] HYDRAULICALLY ACTUATED WELL SHIFTING TOOL

[75] Inventor: Brian A. Roth, Houston, Tex.

[73] Assignee: Camco International Inc., Houston, Tex.

[21] Appl. No.: 724,230

[22] Filed: Jul. 1, 1991

[51] Int. Cl.[5] ..... E21B 23/00; E21B 34/00

[52] U.S. Cl. ..... 166/319; 166/374

[58] Field of Search ..... 166/319-322, 166/332-334, 374, 317

[56] References Cited

U.S. PATENT DOCUMENTS

| | | | |
|---|---|---|---|
| 4,542,792 | 9/1985 | Akkerman | 166/319 X |
| 4,658,902 | 4/1987 | Wesson et al. | 166/317 |
| 4,658,904 | 4/1987 | Doremus et al. | 166/319 X |
| 4,848,463 | 7/1989 | Ringgenberg et al. | 166/319 X |

*Primary Examiner*—Thuy M. Bui

*Attorney, Agent, or Firm*—Fulbright & Jaworski

[57] ABSTRACT

A shifting tool, operating on a single control line, selectively shifts a sliding sleeve in a well to either an open or closed position. The tool includes two sets of shifting dogs to manipulate a sliding sleeve in either direction. The tool includes locking dogs which insure proper location of the shifting tool as well as removing the load from the supporting coil tubing.

15 Claims, 10 Drawing Sheets

HYDRAULICALLY ACTUATED WELL SHIFTING TOOL

BACKGROUND OF THE INVENTION

Various types of well tools commonly used in oil and/or gas well production strings include sliding or shifting members which are required to be actuated. For example, sliding sleeve valves generally include a sleeve which is shifted to open or close ports to provide communication from or shut off communication between the bore of a production string and the well annulus.

The present invention is directed to a hydraulically actuated bi-directional tool, for actuating a sliding member in a well shifting tool. The present invention has the advantages in that it is bi-directional in the shifting operation, that is, it can selectively shift a sliding member two ways, the hydraulic tool can be operated either horizontally or vertically and thus is an advantage over conventional jarring type tools. The tool can selectively manipulate an individual sliding member and the tool is operated on a single hydraulic control line.

SUMMARY

The present invention is directed to a hydraulically actuated shifting tool for actuating a sliding member in a well tool and includes a housing having a hydraulic fluid bore therein. Shifting dog means are positioned on the housing for movement away and toward the body and the shifting dog means has a contour to engage a sliding member. Locking dog means are positioned on the housing for moving away and towards the body and said locking dog is adapted to latch into a locking recess in a well tool. Shifting dog hydraulic actuating means are provided in fluid communication with the bore for causing engagement of the shifting dogs with the sliding member and locking dog hydraulic actuating means are provided in communication with the bore for causing engagement of the locking dogs with the locking recess. Hydraulic shifting means are provided in communication with the bore for causing relative movement between the shifting dog means and the locking dog means for shifting the sliding member.

Another feature of the present invention is the provision of second shifting dog means positioned on the housing for movement away and towards the body, and said second shifting dog means has a contour to engage and shift the sliding member in an opposite direction to the first shifting dog means. Second shifting dog hydraulic actuating means is provided in communication with the bore for causing engagement of the second shifting dog means with the sliding member and second hydraulic shifting means is provided in communication with the bore for causing relative movement between the shifting dog means and the second locking dog means for shifting the sliding member oppositely to the actuation of the first hydraulic shifting means. Shiftable valve means is provided in communication with the bore for selectively directing fluid for the actuation of the first or second shifting dog means.

Still a further object of the present invention is the provision of catch means for holding the shifting dog means in the retracted position on the housing. Preferably, spring means yieldably acts on the catch means for holding the shifting dog means and also acts against the shifting dog hydraulic actuating means.

Yet a still further object of the present invention is wherein the shifting dog hydraulic actuating means is actuated by less force than the locking dog hydraulic actuating means.

Still a further object of the invention is wherein the shifting dog hydraulic actuating means includes a first piston and the locking dog hydraulic actuating means includes a second piston. A first spring is provided opposing the actuation of the first piston and a second spring is provided opposing the actuation of the second piston and said second spring is stronger than the first spring.

A still further object of the present invention is wherein a single hydraulic control line is connected to the bore of the housing and extends upwardly out of the well for controlling the actuation of the shifting tool.

A still further object of the present invention is the provision of a hydraulically actuated shifting tool which includes a housing which includes a valve housing having a hydraulic fluid bore therein, a lock housing connected to the valve housing, and a shifting dog housing slidable on and longitudinally movable relative to the valve housing. The lock housing includes locking dog means, a locking dog wedge for locking the locking dog means into a locking recess in a sliding sleeve, a hydraulic lock piston for actuating the wedge and a return spring acting against the wedge to move the wedge to an unlocked position.

The shifting dog housing includes first and second oppositely directed shifting dog means in which the first and second shifting dog means have a contour to engage and shift a sliding sleeve in opposite directions. The shifting dog housing includes first and second hydraulic pistons for causing engagement of said first and second shifting dog means, respectively, with the sliding sleeve. Shiftable valve means are connected between the valve housing and the shifting dog housing for selectively directing fluid to the first and second hydraulic pistons.

Yet a still further object of the present invention is wherein a check valve is connected between each of the first and second hydraulic pistons and the outside of the housing for releasing trapped hydraulic fluid.

Still a further object of the present invention is the provision of a pilot valve in the hydraulic fluid bore allowing fluid to flow to the first and second hydraulic pistons.

Yet a still further object of the present invention is the provision of a releasable collet releasably connecting the shifting dog housing and the valve housing.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
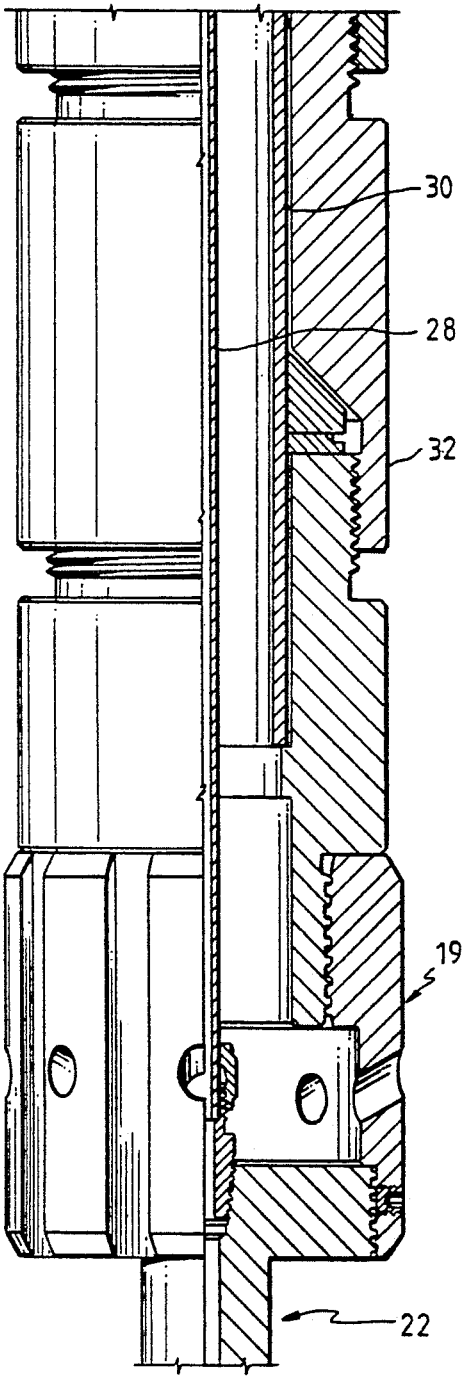
FIGS. 1A through 1G are continuations of each other and constitute an elevational view, in quarter section, of the shifting tool of the present invention.

While the hydraulic shifting tool of the present invention is shown, for purposes of illustration only, of actuating a sliding sleeve valve, it is to be understood that the shifting tool may be used to actuate other slidable members in well tools.

Referring now to the drawings, and particularly to FIGS. 2A, 2B, 2C and 2D, the reference numeral 10 generally indicates a typical sliding sleeve valve having a housing 11, one or more ports 12, and a longitudinal slidable sleeve 13 telescopically slidable in the housing 11. The sleeve 13 also includes one or more ports 14. By moving the sleeve 13 upwardly or downwardly, the ports 12 and 14 are brought into alignment or out of alignment, respectively. (Packing between the sleeve 13 and housing 11 is omitted for clarity.) Detent means is normally provided between the sleeve 13 and the housing 11, such as notches 15 and 16 in the sleeve 13 and a detent 17 in the housing for yieldably holding the sleeve 13 in an upwardly or downwardly position. In addition, the housing 11 includes a locking recess 18.

The sliding sleeve valve 10 is normally positioned in an oil and/or gas well production tubing and the valve is actuated between an open and closed position for providing communication between the bore of the housing 11 and the exterior of the housing 11 which is normally the well annulus.

The present invention is directed to a hydraulically actuated shifting tool for manipulation of the sliding sleeve 13. While the shifting tool will be described for purposes of illustration only as shifting the sliding sleeve 13 selectively either to an open or closed position, that is, in either direction, it is recognized that the present invention can be used to shift the sleeve 13 in only a single direction if desired.

Referring now to FIGS. 2A-2D and 1A-1G, the reference numeral 19 generally refers to the shifting tool of the present invention and includes a housing 20 which includes a valve housing 22, a lock housing 24 connected to the valve housing 22, and a shifting dog housing 26 which is slidable on and longitudinally movable relative to the valve housing 22. The shifting tool 19 is supported from coil tubing 30 by a coil tubing connector 32. The valve housing 22 includes a single hydraulic control line 28 therethrough which extends through the coil tubing 30. Hydraulic control fluid is supplied through the line 28 from the well surface to actuate the shifting tool 19 of the present invention as will be more fully discussed hereinafter. Pilot valve 29 is positioned in control line 28 to prevent the premature release of shifting dogs 42.

Figure 1B:
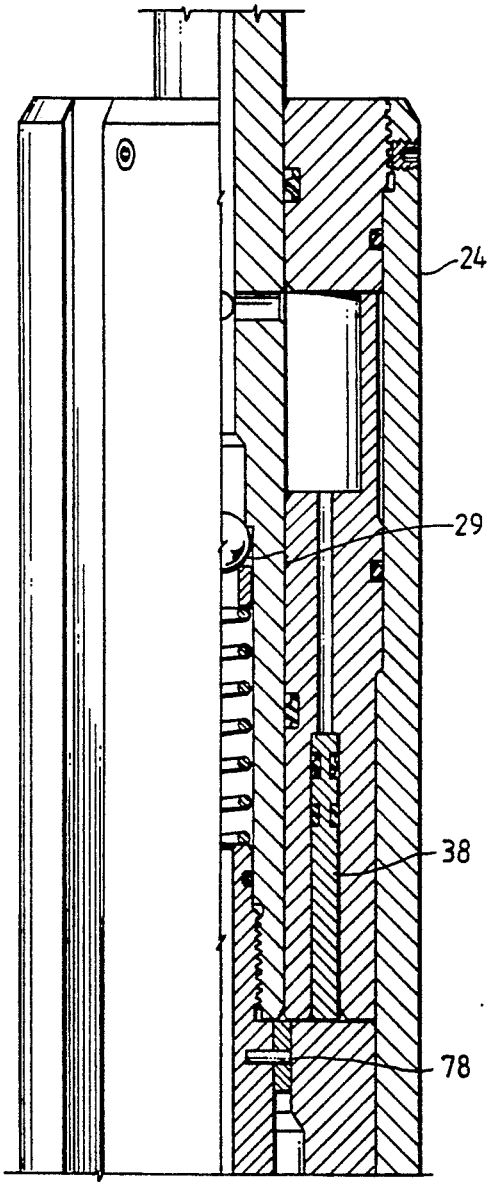
Figure 1C:
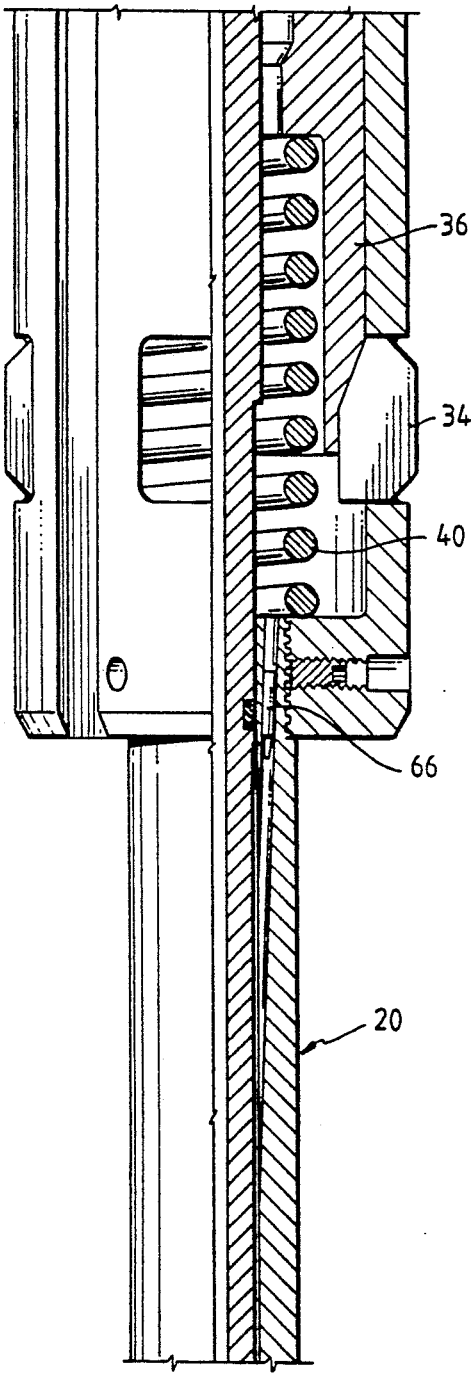

Referring now particularly to FIGS. 1B and 1C, the lock housing 24 includes locking dog means such as a plurality of locking dogs 34, a locking dog wedge 36 which when moved downwardly, moves the locking dog 34 out of the lock housing 24 and into the locking recess 18 of the sliding sleeve valve 10. In addition, the locking housing 24 includes a hydraulic lock piston 38 which is in fluid communication with the control line 28 for actuating the wedge 36. A return spring 40 in the lock housing 24 acts against the wedge 36 to move the wedge to an unlocked position for allowing retraction of the locking dogs 34 into the locked housing 24.

Figure 1D:
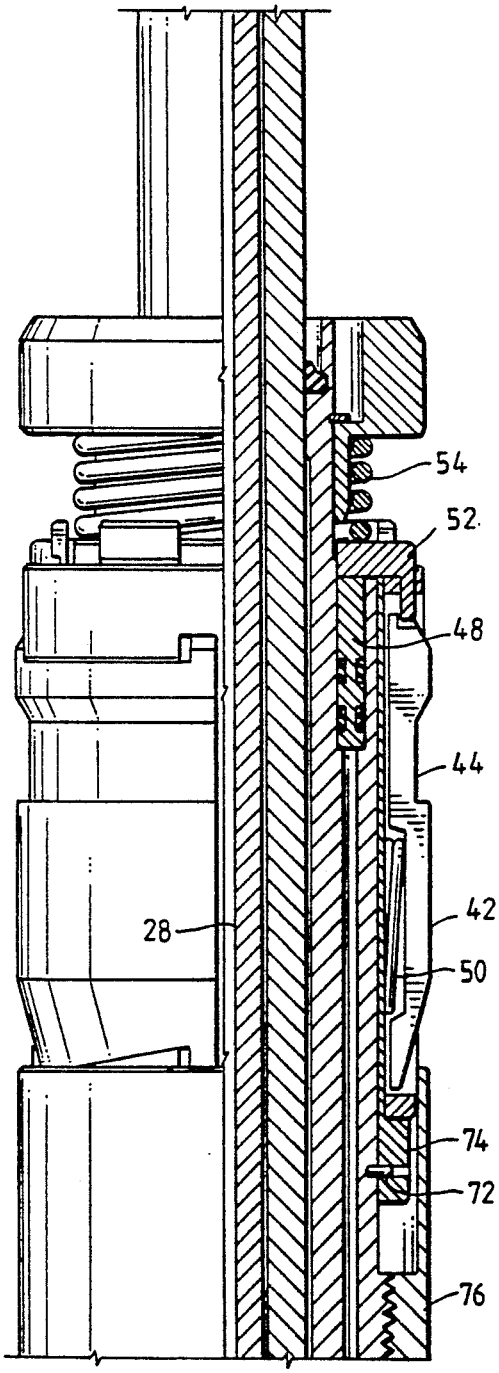
Figure 1E:
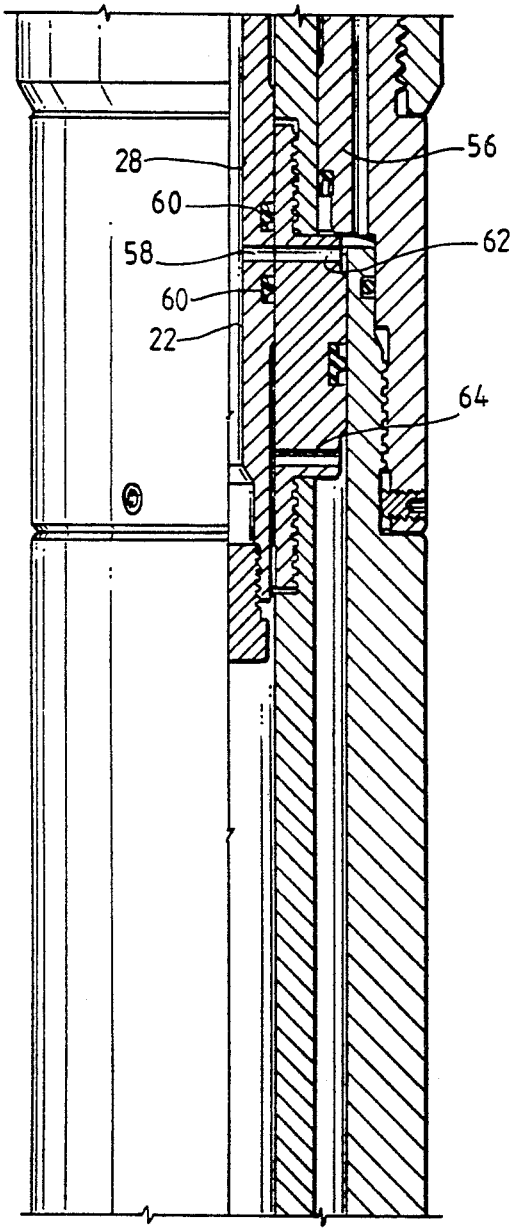
Figure 1F:
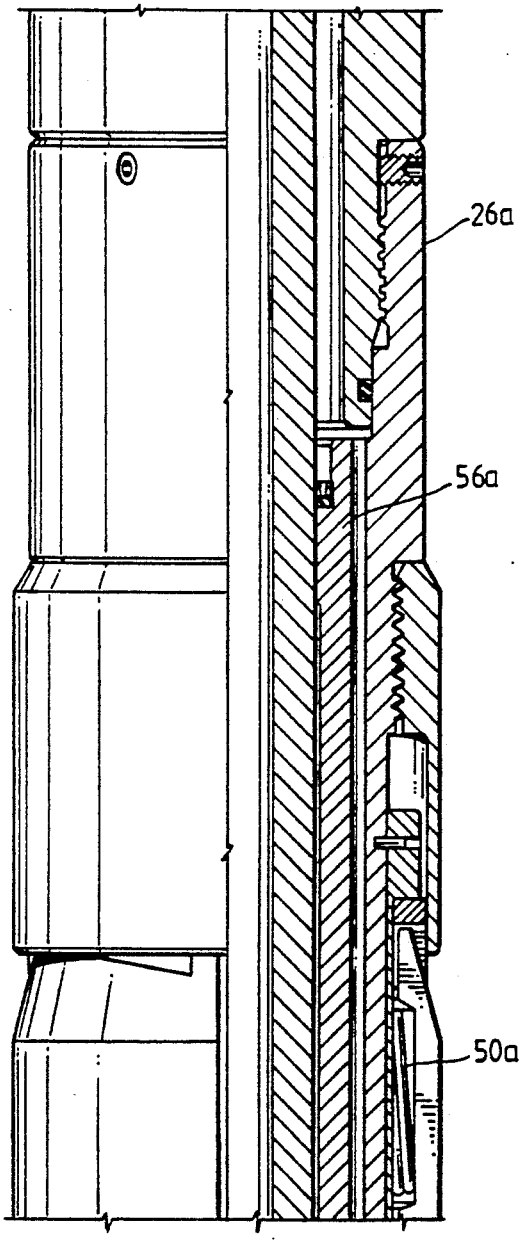
Figure 2A:
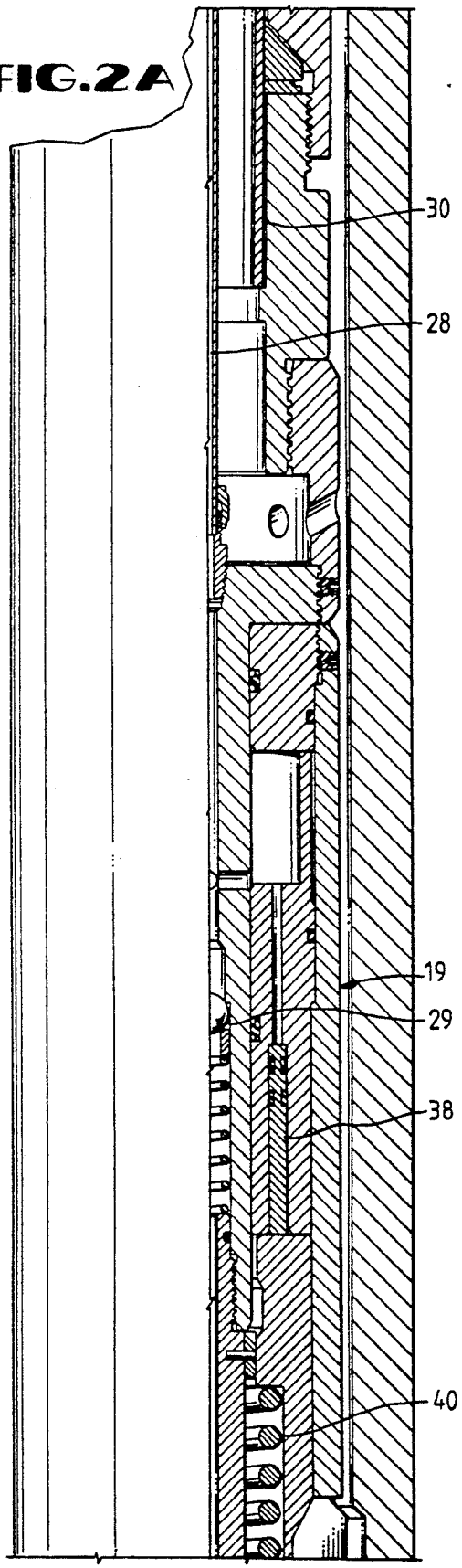
FIGS. 2A through 2D are continuations of each other and constitute a schematic elevational view, in quarter section, of the shifting tool of the present invention being run into a sliding sleeve valve, FIGS. 3A through 3D constitute an elevational view, in quarter section, of the shifting tool of the present invention in position shifting a sliding sleeve valve upwardly, and FIGS. 4A through 4D constitute an elevational view, in quarter section, of the shifting tool of the present invention in position finishing the downstroke of moving the sliding sleeve valve.
Figure 2B:
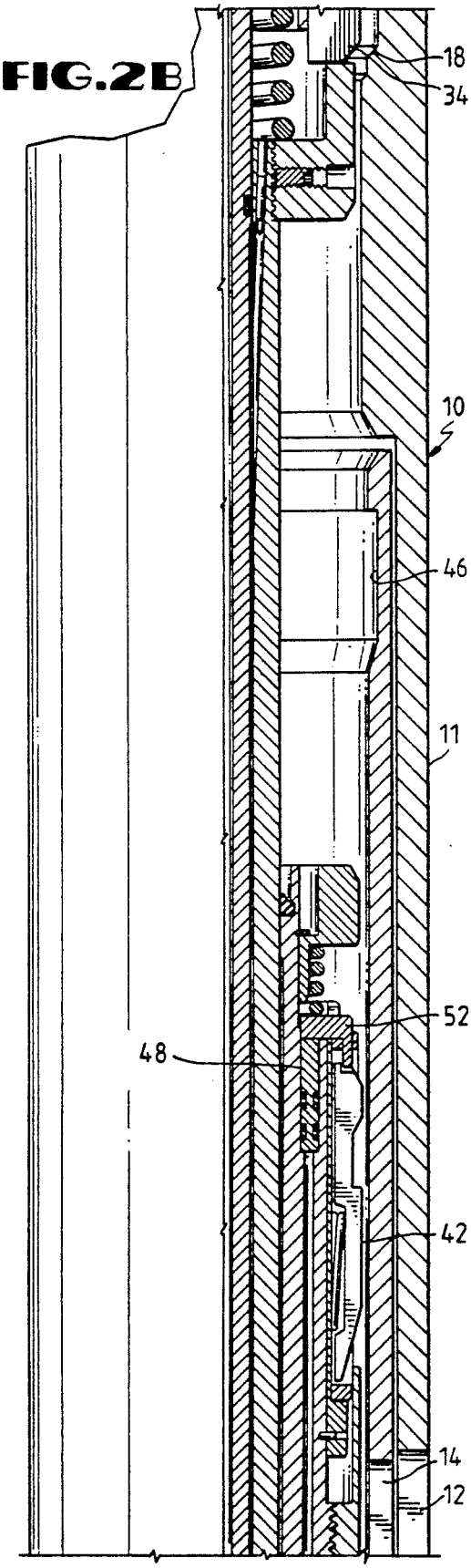

Referring now to FIGS. 1D and 1E, the shifting dog housing 26 includes shifting dog means such as a plurality of shifting dogs 42 which are positioned on the housing 26 for movement away and towards the housing 26. The shifting dogs 42 include a contour 44 shaped to coact with a sliding member in a well tool such as the contour 46 on the sliding sleeve 13 (FIG. 2B). Shifting dog hydraulic actuating means, such as piston 48, is provided to be in fluid communication with the control line 28 for causing outward movement of the shifting dogs 42 into engagement with the sliding sleeve recess 46 in the sliding sleeve 13. The shifting dogs 42 are biased outwardly away from the housing 26 by shifting dog springs 50, but the shifting dogs 42 are normally held in a retracted position by a catch 52 while the shifting tool 19 is being run into the well. The catch 52 is urged into a latching position on the ends of the shifting dogs 42 by a catch return spring 54. When the shifting dog piston 48 is actuated, it moves the catch 52 away from the shifting dogs 42 thereby allowing them to be biased outwardly from the housing 26 by the spring 50.

In addition, hydraulic shifting means are provided such as hydraulic piston 56 which, when actuated, moves the shifting dog housing 26 and lock housing 24 towards each other as will be more fully described hereinafter.

Preferably, the shifting dog housing 26 includes a second set of shifting dog means. The second set of dog means, while similar to the first set, are oppositely directed for moving the sliding sleeve 13 in the opposite direction to which it is moved by the shifting dogs 42. Thus, referring to FIGS. 1E, 1F and 1G, a second set of shifting dog means such as shifting dogs **42*a* are provided mounted for movement away from and towards the shifting dog housing 26*a* and include a contour 44*a* which is adapted to engage a contour 46*a* (FIG. 2C) on the sliding sleeve 13. A shifting dog hydraulic piston 48*a* is provided to cause release and outward movement of the shifting dogs 44*a* by a shifting dog spring 50*a* after release by catch 52*a* when the piston 48*a* overcomes the catch return spring 54*a*. In addition, a hydraulic shifting piston 56*a* is provided for shifting the shifting dog housing 26*a* relative to the lock housing 24 in the opposite direction from the actuation by the hydraulic shifting piston 56**.

In order to determine which of the shifting dogs 42 or **42*a* are actuated, a shiftable valve means is connected between the valve housing 22 and the shifting dog housing 26 for selectively directing hydraulic control fluid from the line 28 to one of the sets of shifting dogs. Thus, referring to FIG. 1E, the valve housing 22 includes a port 58 between seals 60. Movement of the valve housing 22 may selectively place the port 58 in communication with an upper inlet 62 or a lower inlet 64. As shown in FIG. 1E in the position shown, the port 58 is in fluid communication with the upper inlet 62 thereby supplying hydraulic control fluid to the shifting dog piston 48 and to the hydraulic shifting piston 56**.

A check valve is provided in communication with each of the hydraulic shifting pistons 56 and **56*a*. Thus, check valve 66 is in fluid communication with the hydraulic shifting piston 56 for relieving the hydraulic fluid trapped in the chamber of piston 56 when the valve housing 22 is shifted downwardly to move the port 58 out of communication with the inlet 62 thereby exposing the inlet 62 to check valve 66. When the valve housing 22 is in the position shown in FIG. 1E, the port 58 is out of contact with the inlet 64 thereby releasing hydraulic fluid from behind the piston 56***a* through a check valve 66*a*.

Figure 1G:
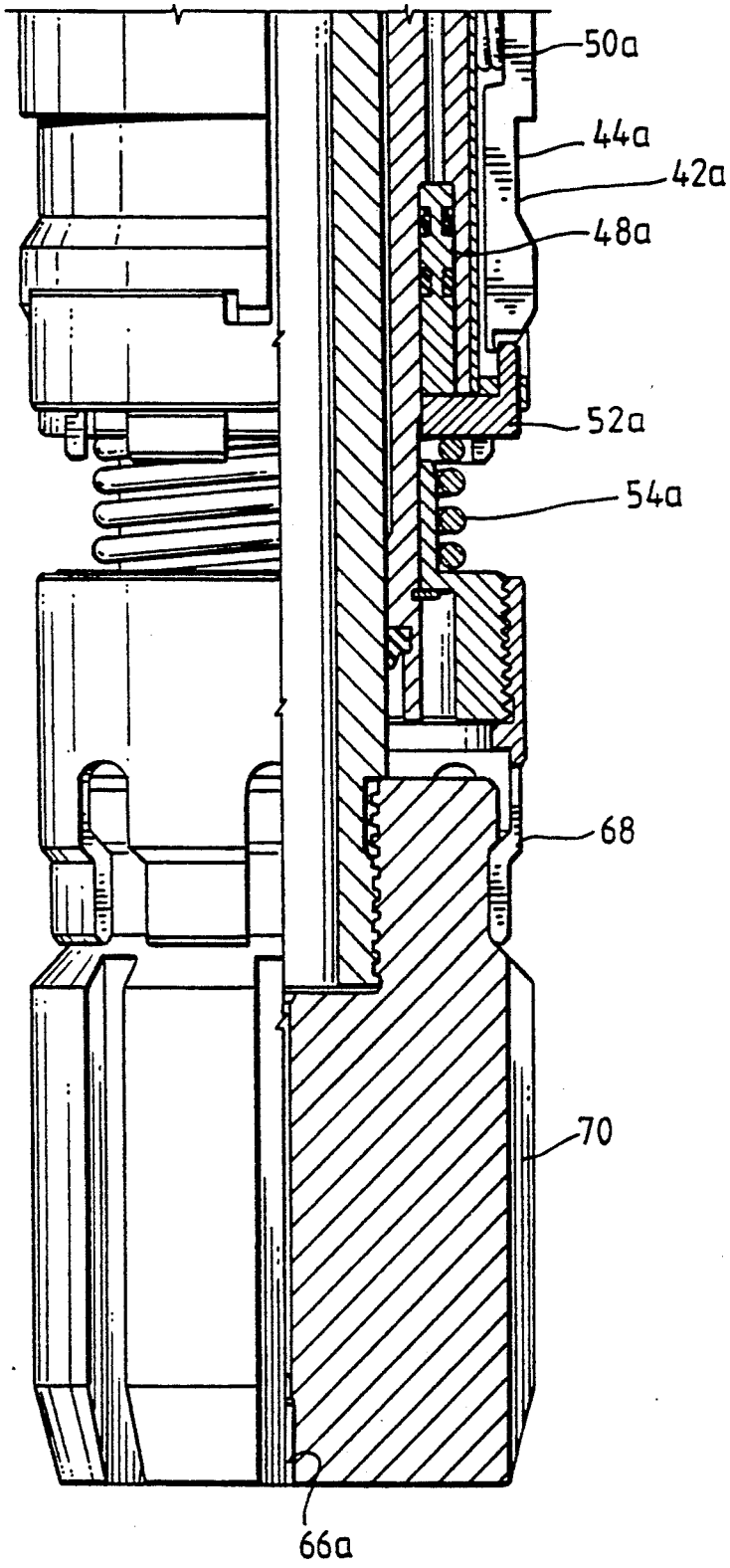

Referring now to FIG. 1G, a nose collet 68 is provided engaging the nose 70 merely for holding the valve housing 22 in position relative to the shifting dog housing 26 while the tool 19 is being run in.

One of the sets of shifting dogs 42 or 42*a* may be omitted if it is desired to move the sliding sleeve 13 in a single direction. However, the use of both shifting dogs 42 and 42*a* provides a hydraulically actuated bidirectional shifting tool which may selectively shift a sliding sleeve 13 either open or closed as well as individually select which sleeve in the production string to manipulate in a string having a plurality of sliding sleeves. Furthermore, the hydraulically actuated tool 19 may manipulate the sliding sleeve 13 whether it is in the horizontal or vertical position.

If, during operations, the shifting tool 19 becomes stuck while coming out of the production tubing, a shear pin 72 (FIG. 1D) located on the collet 74 of the upper shifting dog 42 will shear, allowing the shifting dog 42 and collet 74 to slide and wedge under the upper sleeve 78. The OD of the shifting dog 42 is now contracted to less than the ID of the well tool 10 and may be removed.

If the shifting tool 19 is stuck because the locking dogs 34 will not retract, a pin 76 (FIG. 1B) is sheared, releasing the valve housing 22 from the remainder of the tool 13. A pulling tool can then be run into position in the recess behind the locking dog wedge 36 and pulled upwardly to release the locking dogs and the remainder of the tool 19.

In operation, and referring to FIGS. 2A–2D, the shifting tool 19 of the present invention is lowered down the production tubing on a coil tubing 30 and into the sliding sleeve valve 10. As best seen, the shifting dogs 42 and 42*a* and the locking dogs 34 are in the retracted position. Since the shifting dog housing 26 is longitudinally movable on the valve housing 22, the shifting dog housing 26 will be in a downward position relative to the valve housing 22. In order to move the sliding sleeve upwardly, the shifting tool 19 is run into a position wherein the upper shifting dog 42 are positioned below the contour 46 on the sliding sleeve 13 which they are to engage in order to move the sleeve 13 upwardly. When in this position, the valve housing 22 is moved upward and due to the drag on the OD of the tool 19 the port 58 is placed in communication with the inlet 62. The hydraulic control fluid in the control line 28 is pressurized, moving pressurized control fluid through the line 28 into the chamber behind the lock piston 38, through the pilot valve 29, and against the back of the upper latch piston 48. It is to be particularly noted that the actuation of the locking dogs 34 requires greater force than to actuate the shifting dogs 42. That is, the locking dog spring 40 provides a greater force against the lock piston 38 than the catch return spring 54 provides against the upper latch piston 48. Therefore, at a lower level of hydraulic pressure in the line 28, the upper latch piston 48 will move and overcome the spring 54 releasing the catch 52 allowing the shifting dog spring 50 to be extended outwardly from their housing 26.

With the upper shifting dog 42 extended, the coil tubing 30 and the shifting tool 19 is moved upwardly until the contour 44 on the shifting dog 42 engages the contour 46 on the sliding sleeve 13. This fact is noted by a greater force being exerted at the well surface on the coil tubing 30.

When the shifting dogs 42 engage the contour 46, the locking dogs 34 are then positioned above the locking recess 18 in the valve 10. The hydraulic pressure in the control line 28 is then increased to expand the locking dogs 34.

Also, the increased hydraulic fluid acting on the hydraulic shifting piston 56 moves the shifting dog housing 26 and the lock housing 24 towards each other. This causes the lock housing 24 to move downwardly since the shifting dogs 42 have engaged the recess 46 in the sleeve 13. The lock housing 24 continues downwardly until the locking dogs 34 latch into the locking recess 18 in the valve housing 11. Hydraulic pressure in the line 28 is further increased to shift the sliding sleeve 13 upwardly. It is noted that the load of shifting the sleeve 13 upwardly is not being carried by the coil tubing 30, but instead on the locking dogs 34.

At the end of the upstroke, as best seen in FIGS. 3A–3D, the shifting dogs 42 engage a shoulder 78 in the housing 11 causing the shifting dogs 42 to retract back into the shifting dog housing 26. The sleeve 13 has now been shifted to the upward position to provide alignment of the openings 12 and 14. Thereafter, the fluid pressure in the control line 28 is released allowing the locking dogs 34 to retract, the valve housing 22 is moved downwardly to move the port 58 out of engagement with the fluid inlet 62 in the shifting dog housing thereby allowing release of the hydraulic fluid in the chamber behind the piston 56 to flow outwardly through the check valve 66. This allows catch return spring 54 to move the catch 52 towards the shifting dogs 42 and to reengage and hold the shifting dogs 42 in the retracted position. The coil tubing 30 is moved upwardly to allow the collet 68 to catch onto the nose 70. The shifting tool 19 can then be moved to another position.

Figure 2C:
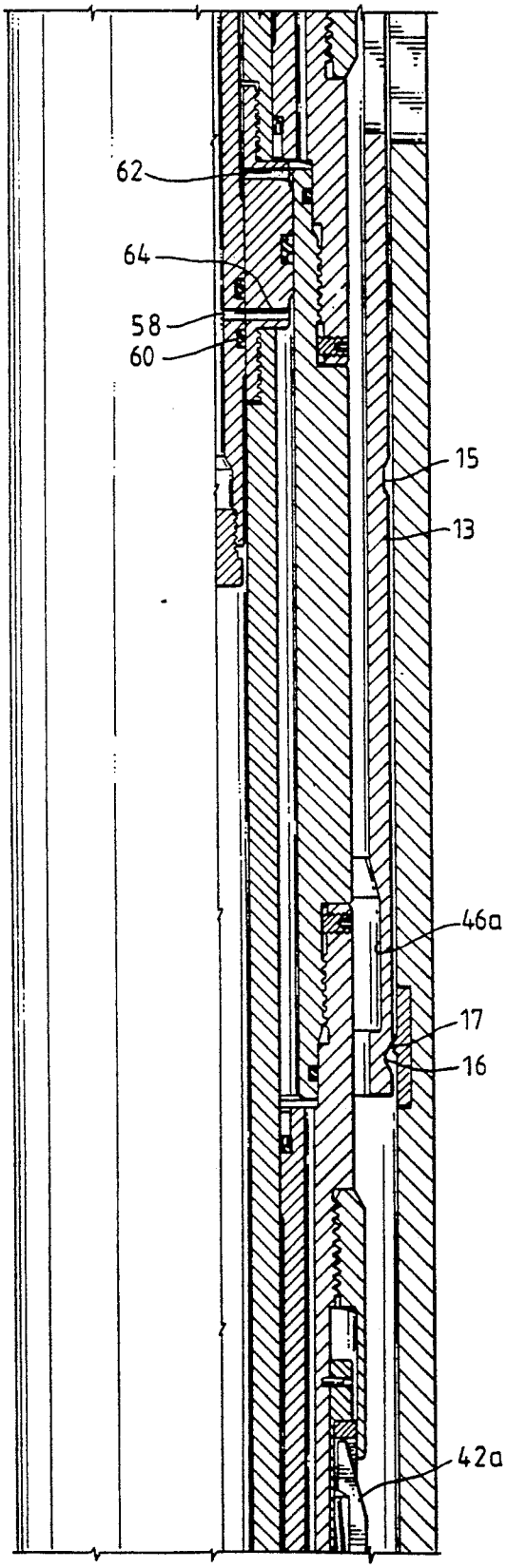
Figure 2D:
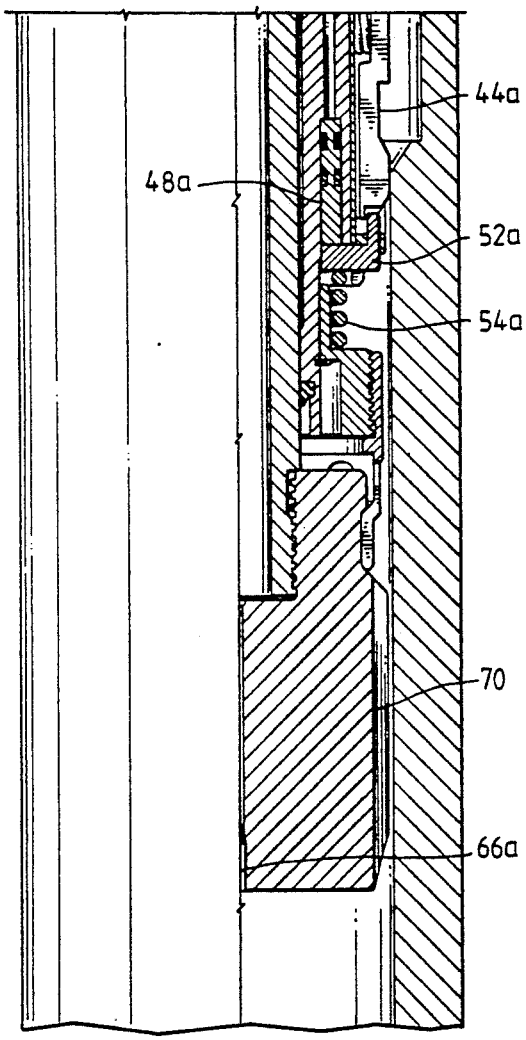
Figure 3A:
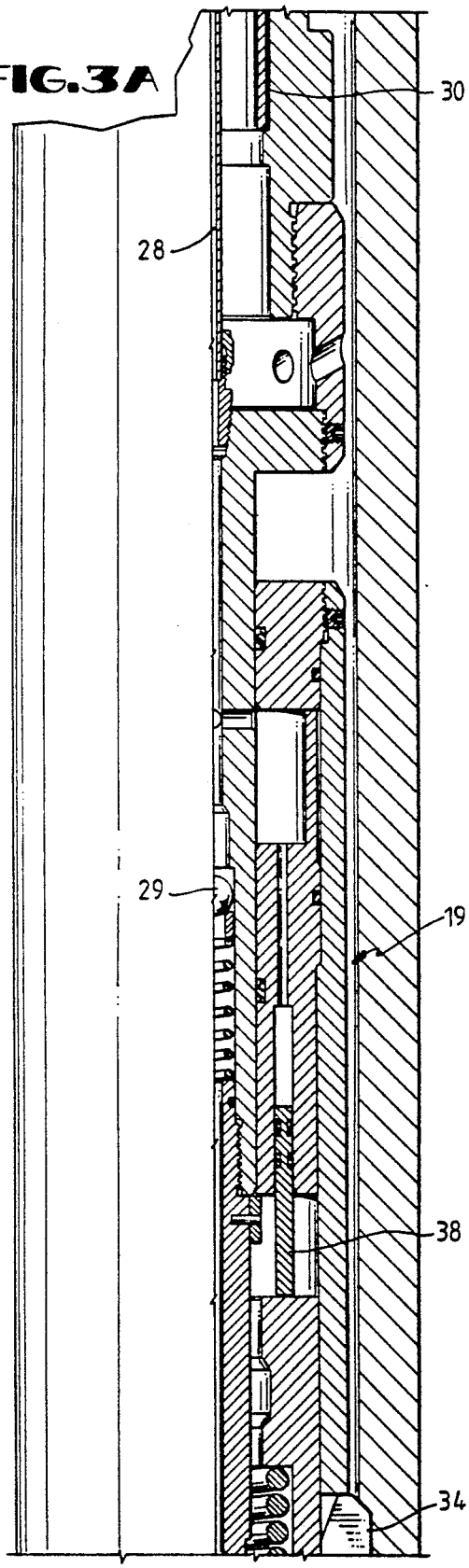
Figure 3B:
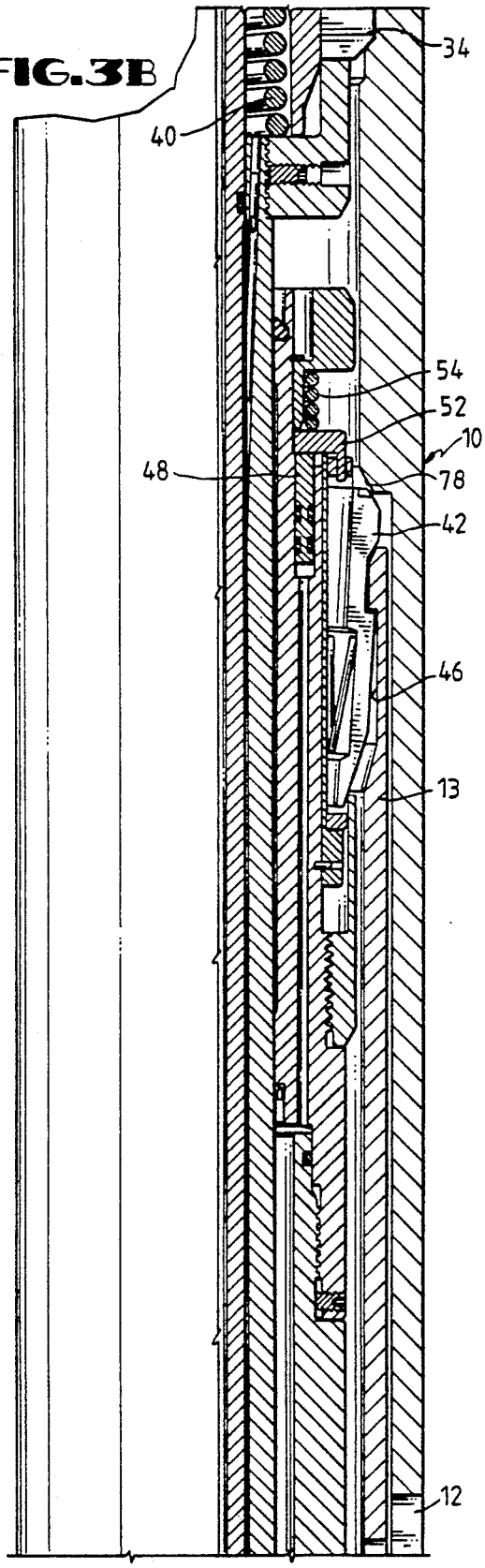
Figure 3C:
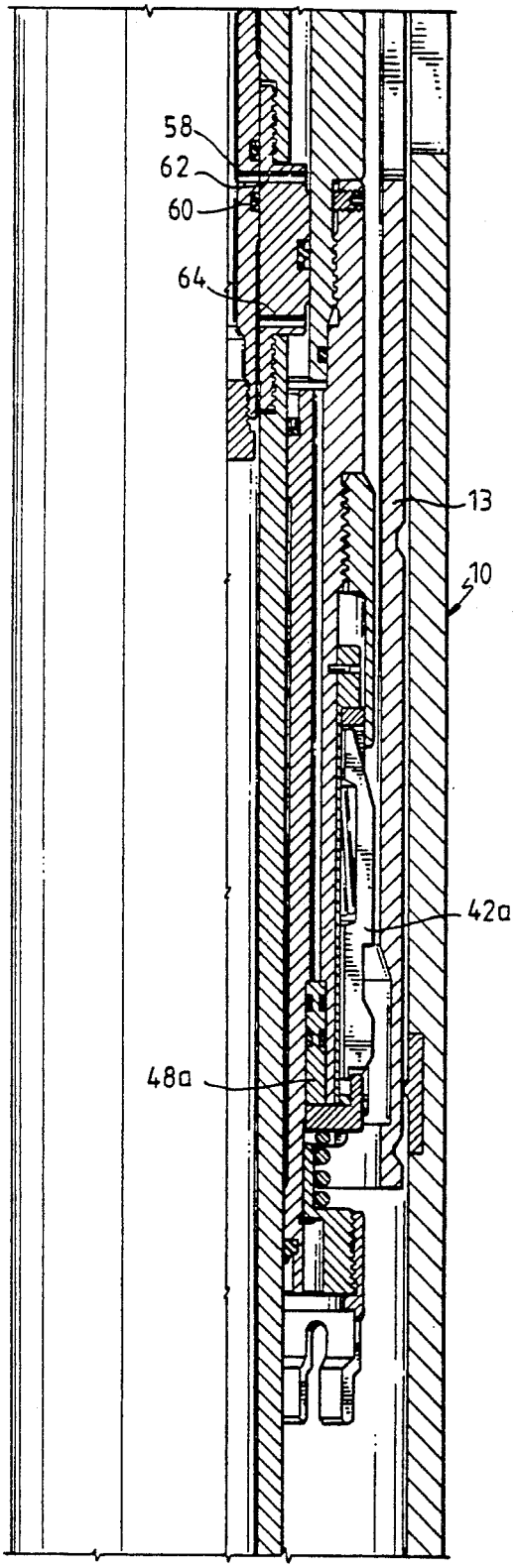
Figure 3D:
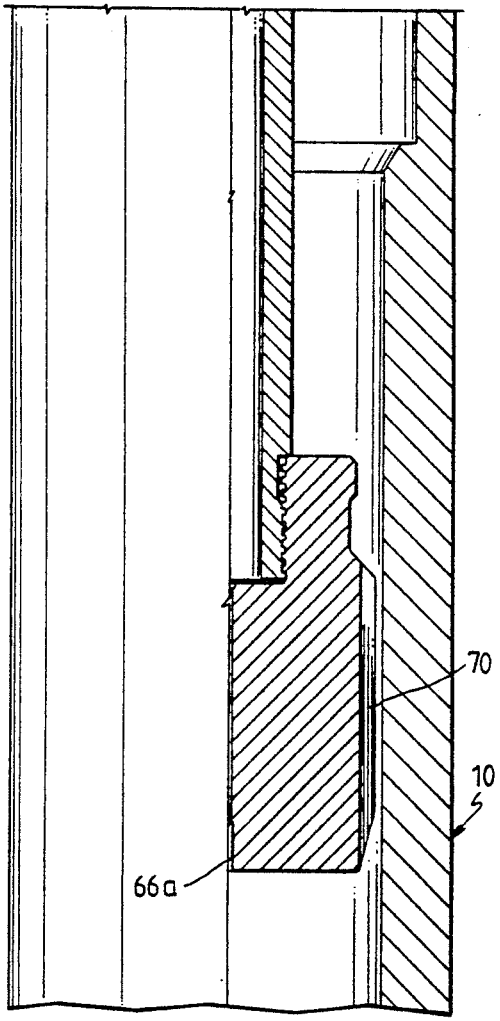

In order to move the sliding sleeve 13 downwardly, assuming that it is in the position shown in FIGS. 2B and 2C, the shifting tool 19 is moved downwardly in the well into the sliding sleeve valve 10 to position the lower shifting dogs 42*a* in a position above the contour 46*a* on the sliding sleeve 13. The control line 28 is pressurized to actuate the lower piston 48*a* which releases the catch 52*a* prior to the actuation of the locking dogs because, again, the locking dog spring 40 has a greater force than the catch return spring 54*a*. When the catch 52*a* is released, the lower shifting dogs 42*a* are released and extended from the shifting dog housing 26 by the spring 50*a*. The shifting tool 19 is then moved downwardly until the contour 44*a* on the shifting dogs 42*a* engage and lock into the lower contour 46*a* on the sliding sleeve 13 by downward movement of the coil tubing 30 and shifting tool 19. The engagement of the lower shifting dogs 42*a* and sliding sleeve 13 exerts a greater force on the coil tubing 30. The hydraulic pressure is increased in the line 28 to expand the locking dogs 34 which are at this time positioned above the locking notch 18 in the sliding sleeve valve 10. The increase in hydraulic pressure causes the locking dogs 34 to expand against the ID of the sliding valve 10.

Since the shifting tool 10 has been lowered into the sliding sleeve valve, the sliding sleeve dog housing 26 has frictionally engaged the interior of the well tubing and therefore the port 58 in the valve housing is in fluid communication with the outlet 64.

An increase of fluid pressure through and behind the shifting piston 56*a* moves the shifting dog housing 26 away from the lock housing 24 causing the locking dogs 34 to become aligned with and latch into the locking recess 18. Continued actuation of the piston 56*a* shifts the sleeve 13 downwardly as the locking dogs 34 are locked in place causing the shifting dog housing 26 to move downwardly relative to the lock housing 24 thereby carrying the sleeve 13 downwardly.

Figure 4A:
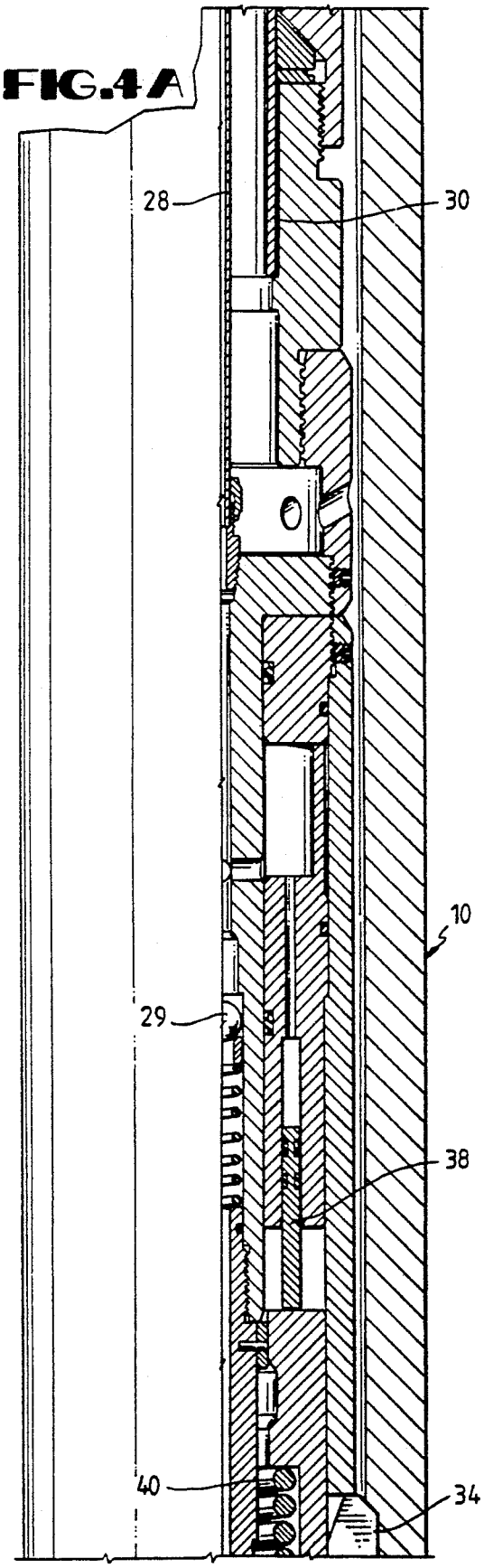
Figure 4B:
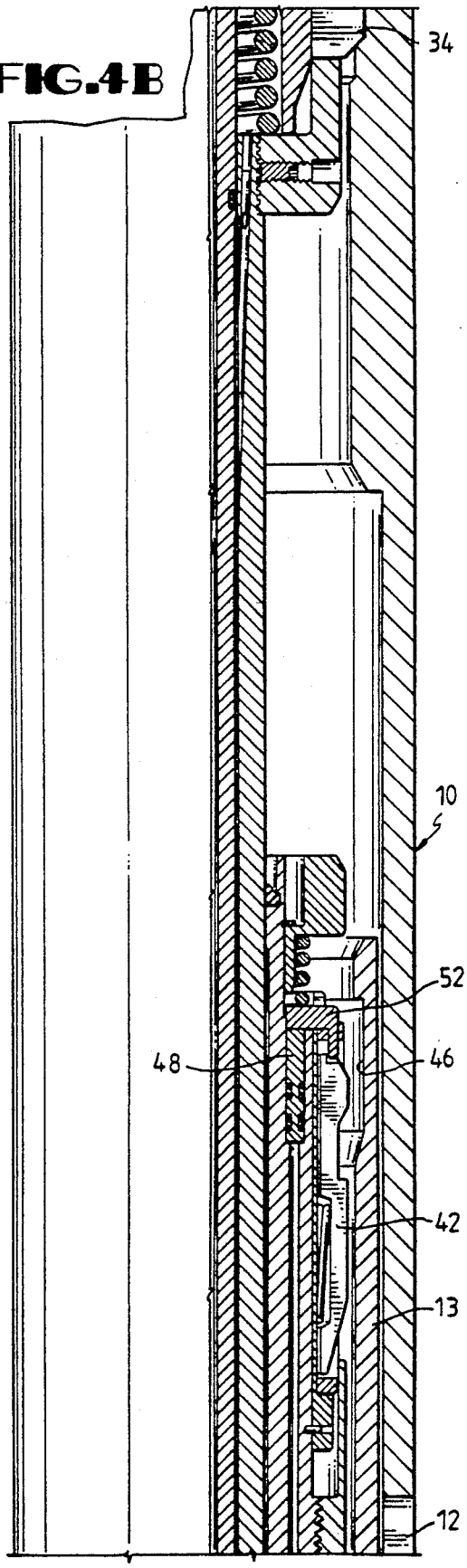
Figure 4C:
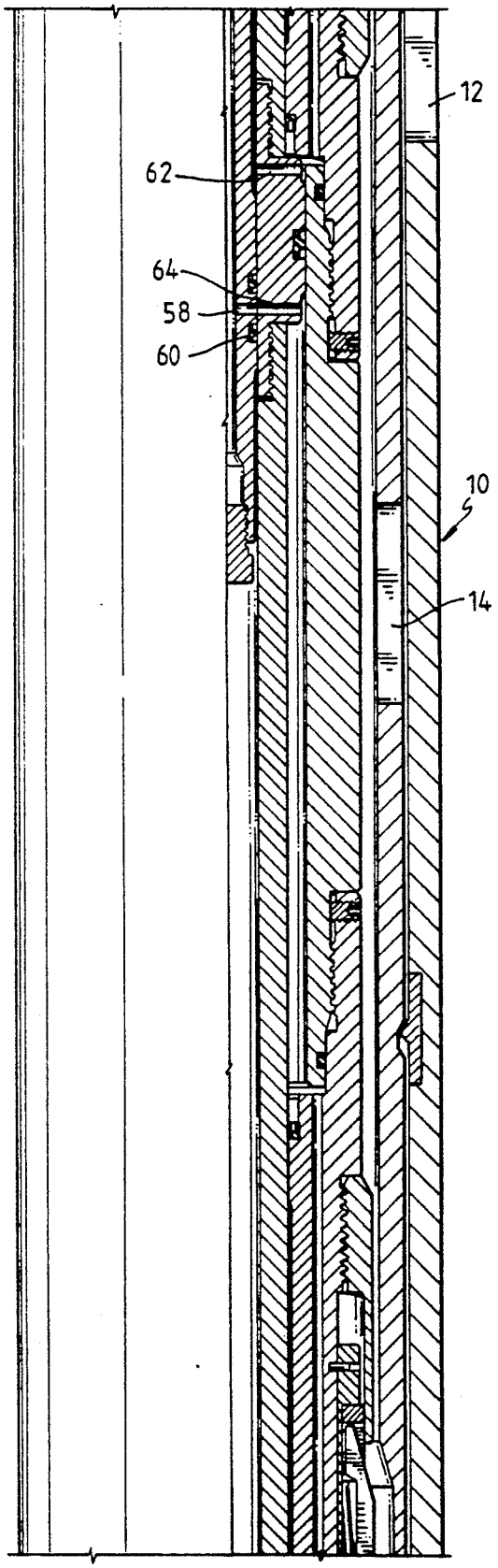
Figure 4D:
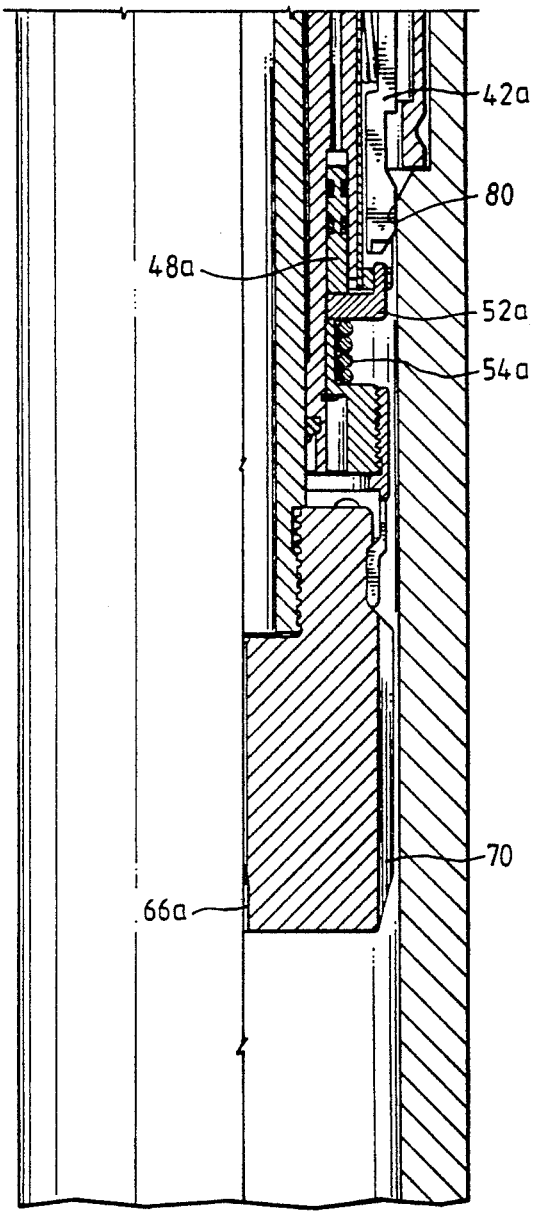

At the end of the downward stroke, as best seen in FIGS. 4A–4B, the sliding sleeve 13 has moved to its down stop, closing the sliding sleeve valve 10. In addition, the lower shifting dogs 42*a* have contacted shoulder 80 in the housing 11 and therefore are retracted back into the shifting dog housing 26. Again, releasing the hydraulic pressure in the line 28 allows the locking dogs 34 to retract, the valve housing 22 is shifted to release the hydraulic fluid behind the piston 56*a* through the check valve 66*a* thereby allowing the catch 52*a* to engage and retain the shifting dogs 42*a* in the retracted position. The shifting tool 19 is then available to be run into another sliding sleeve valve 10 or withdrawn from the well.

The present invention is useful in that it is bi-directional in its shifting operation, can be operated either horizontally or vertically, can selectively manipulate an individual sliding member in a well tool, and is manipulated by a single hydraulic control circuit.

The present invention, therefore, is well adapted to carry out the objects and attain the ends and advantages mentioned as well as others inherent therein. While a presently preferred embodiment of the invention has been given for the purpose of disclosure, numerous changes in the details of construction, and arrangement of parts, will be readily apparent to those skilled in the art and which are encompassed within the spirit of the invention and the scope of the appended claims.

What is claimed is:

1. A hydraulically actuated shifting tool for actuating a sliding member in a well tool comprising, a housing having a hydraulic fluid bore therein, shifting dog means positioned on the housing for movement away and toward the housing, said shifting dog means having a contour to engage a sliding member, locking dog means positioned on the housing for movement away and toward the body, said locking dog adapted to latch into a locking recess in a sliding member well tool, shifting dog hydraulic actuating means in fluid communication with the bore for causing engagement of the shifting dogs with the sliding member, locking dog hydraulic actuating means in communication with the bore for causing engagement of the locking dogs with the locking means, and hydraulic shifting means in communication with the bore for causing relative movement between the shifting dog means and the locking dog means for shifting the sliding sleeve.

2. The apparatus of claim 1 including, second shifting dog means positioned on the housing for movement away and toward the body, said second shifting dog means having a contour to engage and shift the sliding member in an opposite direction to the first shifting dog means, and second shifting dog hydraulic actuating means in communication with the bore for causing engagement of the second shifting dog means with the sliding member, second hydraulic shifting means in communication with the bore for causing relative movement between the shifting dog means and the locking dog means for shifting the sliding member oppositely to the actuation of the first hydraulic shifting means, and shiftable valve means in communication with the bore for selectively directing fluid for the actuation of the first or second shifting dog means and first or second hydraulic shifting means.

3. The apparatus of claim 1 including, catch means for holding the shifting dog means in the retracted position on the housing.

4. The apparatus of claim 3 including, spring means yieldably acting on the catch means for holding the shifting dog means, said spring acting against the shifting dog hydraulic actuating means.

5. The apparatus of claim 1 wherein said shifting dog hydraulic actuating means is actuated by less force than said locking dog hydraulic actuating means.

6. The apparatus of claim 1 wherein the shifting dog hydraulic actuating means includes a first piston and the locking dog hydraulic actuating means includes a second piston and including, a first spring opposing the actuation of the first piston, and a second spring opposing the actuation of the second piston, and said second spring being stronger than the first spring.

7. The apparatus of claim 1 wherein a single hydraulic control line is connected to the bore of the housing and extends upwardly out of the well.

8. A hydraulically actuated sliding sleeve shifting tool for actuating a sliding sleeve in a well comprising, a housing including a valve housing having a hydraulic fluid bore therein, a lock housing connected to the valve housing, and a shifting dog housing slidable on and longitudinally movable relative to the valve housing, said lock housing including locking dog means, a locking dog wedge for locking the locking dog means into a locking recess in a sliding sleeve, a hydraulic lock piston for actuating the wedge, and a return spring acting against the wedge to move the wedge to an unlocked position, said shifting dog housing including first and second oppositely directed shifting dog means, said first and second shifting dog means having a contour to engage and shift a sliding sleeve in opposite directions, said shifting dog housing including first and second hydraulic pistons for causing engagement of said first and second shifting dog means, respectively, with said sliding sleeve, and said shifting dog housing including first and second hydraulic shifting pistons for shifting the shifting dog housing in opposite directions, respectively, relative to the lock housing, shiftable valve means connected between the valve housing and the shifting dog housing for selectively directing fluid to the first and second hydraulic shifting pistons.

9. The apparatus of claim 8 including, spring loaded catch means for holding each of the first and second dog means in a retracted position on the shifting dog housing.

10. The apparatus of claim 8 wherein the first and second hydraulic pistons are actuated by less force than the hydraulic lock piston.

11. The apparatus of claim 9 wherein said spring return in the lock housing is stronger than the spring load catch.

12. The apparatus of claim 8 wherein a single hydraulic control line is connected to the bore of the valve housing and extends upwardly out of the well.

13. The apparatus of claim 8 including, a check valve connected between each of the first and second hydraulic pistons and the outside of the housing for releasing trapped hydraulic fluid.

14. The apparatus of claim 8 including, a pilot valve in the hydraulic fluid bore allowing fluid to flow to the first and second hydraulic pistons.

15. The apparatus of claim 8 including, a releasable collet releasably connecting the shifting dog housing and the valve housing.

* * * * *